United States Patent [19]

Theurer et al.

[11] Patent Number: 4,530,403

[45] Date of Patent: Jul. 23, 1985

[54] BALLAST CLEANING MACHINE

[75] Inventors: Josef Theurer, Vienna; Karl Fölser; Friedrich Oellerer, both of Linz, all of Austria

[73] Assignee: Franz Plasser Baumaschinen Industriegesellschaft M.B.H, Vienna, Austria

[21] Appl. No.: 460,893

[22] Filed: Jan. 25, 1983

[30] Foreign Application Priority Data

Mar. 10, 1982 [AT] Austria ..... 959/82

[51] Int. Cl.[3] ..... E01B 27/00

[52] U.S. Cl. ..... 171/16; 37/107; 198/861

[58] Field of Search ..... 171/16; 37/104–107; 198/861

[56] References Cited

U.S. PATENT DOCUMENTS

| | | | |
|---|---|---|---|
| 1,272,849 | 7/1918 | Pratt | 171/16 |
| 2,142,208 | 1/1939 | Protzeller . | |
| 2,196,880 | 4/1940 | Voorhis et al. | 171/16 |
| 3,356,157 | 12/1967 | Plasser et al. | 171/16 |
| 4,014,389 | 3/1977 | Theurer et al. | 171/16 |

FOREIGN PATENT DOCUMENTS 1067465 5/1967 United Kingdom .

*Primary Examiner*—Richard J. Johnson
*Attorney, Agent, or Firm*—Kurt Kelman

[57] ABSTRACT

A mobile ballast cleaning machine comprising an endless ballast conveying chain movable in a conveying direction, the chain having arranged sequentially in the conveying direction a transverse chain section for excavating the ballast, an upwardly extending elongated chain section for conveying the excavated ballast, the upwardly extending elongated chain section being supported in a guide of channel-shaped cross section and having a bottom defining a plurality of ports for pre-screening the conveyed ballast to separate waste therefrom falling through the ports in the bottom, and a descending elongated chain section leading to the transverse chain section. A vibratory screen is arranged to receive the pre-screened ballast from the upwardly extending elongated chain section to separate residual waste therefrom, a cleaned ballast component remaining on the screening means and the residual waste falling therethrough. A conveyor conveys the waste away.

6 Claims, 3 Drawing Figures

BALLAST CLEANING MACHINE

The present invention relates to a mobile ballast cleaning machine comprising an endless ballast conveying chain movable in a conveying direction, the chain having arranged sequentially in the conveying direction a transverse chain section for excavating the ballast, an upwardly extending elongated chain section for conveying the excavated ballast, and a descending elongated chain section leading to the transverse chain section. A vibratory screen is arranged to receive the ballast from the upwardly extending elongated chain section to separate waste therefrom, a cleaned ballast component remaining on the screening means and the residual waste falling therethrough. A conveyor conveys the waste away and, optionally, further conveying means redistributes the cleaned ballast component.

Many types of such machines for cleaning the ballast under railroad tracks are known, including the mobile ballast cleaning machine disclosed in British Pat. No. 1,067,465, published May 3, 1967, wherein the endless ballast excavating chain is supported in guides and the transverse chain section passes under the track for excavating the ballast while the chain moves in the conveying direction. Such installations have been commercially very successful but it has been found that, in cases where the ballast is very dirty and loaded with waste, the vibratory screening means designed to separate a cleaned ballast component from the waste may be subject to excessive strains.

U.S. Pat. No. 2,142,208, dated Jan. 3, 1939, discloses a machine designed for cleaning solely the ballast in the track shoulders with two sequentially arranged endless conveyor chains. A screen defining circular ports is mounted under the leading endless conveyor chain for depositing smaller ballast stones and the waste on the sub-grade of the track shoulders. A conveyor band and a vibratory screen is associated with the trailing conveyor chain. The entire machine and the manner of cleaning the ballast are rather complex and, therefore, this installation has found no practical application. It should be noted that it is not possible to clean the ballast over the entire width of the track bed therewith.

It is the primary object of this invention to impart increased capacity and efficiency to a mobile ballast cleaning machine of the first-described type.

The above and other objects are accomplished in such a machine according to the invention with a guide of channel-shaped cross section for the upwardly extending chain section, the guide having a bottom defining a plurality of ports for conveying the excavated ballast and pre-screening the conveyed ballast to separate waste therefrom falling through the ports of the bottom.

This simple modification requiring little expense reduces the down time of the machine while increasing the capacity of the excavating chain and the vibratory ballast cleaning screen because a portion of the waste is removed from the excavated ballast through the ports in the bottom of the guide for the upwardly moving excavating chain section before it reaches the cleaning screen. In this arrangement, the movement of the excavating chain relative to the guide supporting it is used to advantage because the motion of the ballast stones during this movement causes considerable friction between the stones, and this friction causes the waste to be rubbed off the ballast stones so that it will readily fall through the ports in the bottom of the guide without the need for vibrating the guide. The pre-screened ballast conveyed to the vibratory screen for effective cleaning will be treated there much more efficiently, thus increasing the operating speed of the installation. In addition, the ballast will be cleaned better because the residual waste will be much more effectively removed from the pre-screened ballast on the vibratory screen than would be the case if the entire original waste remained mixed with the ballast stones.

The above and other objects, advantages and features of the present invention will become more apparent from the following detailed description of a now preferred embodiment thereof, taken in conjunction with the accompanying, generally schematic drawing wherein FIG. 1 is a side elevational view of a mobile ballast cleaning machine according to this invention;

Figure 1:
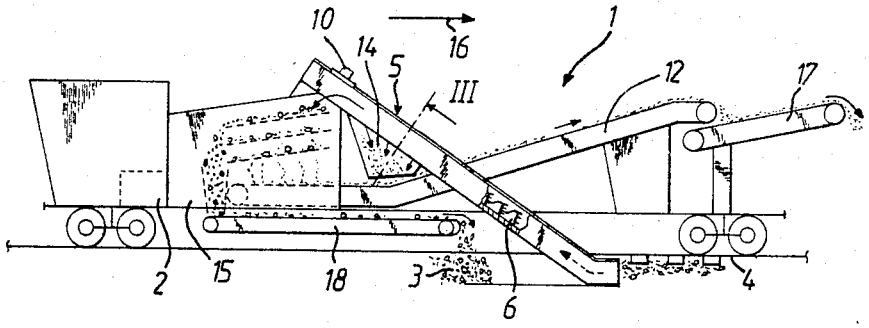

Referring now to the drawing, there is shown mobile ballast cleaning machine 1 carrying power plant 2 for driving the wheels of undercarriages moving the machine in an operating direction indicated by arrow 16 along track 4 resting on ballast 3. Ballast excavating and receiving means 5 is vertically adjustably mounted on the machine between the two undercarriages and includes endless ballast conveying chain 6 movable in a conveying direction indicated by arrow 11 by hydraulic drive 10 about which the chain is trained. The chain is supported and moves in a guide of channel-shaped cross section, and it has arranged sequentially in the conveying direction a transverse chain section in guide section 9 for excavating ballast 3, an upwardly extending elongated chain section for conveying the excavated ballast in guide section 7 and a descending elongated chain section leading to the transverse chain section in guide section 8. This general structure and the operation thereof are well known.

According to the invention, bottom 22 of guide section 7 supporting the upwardly extending elongated section of excavating chain 6 defines ports 13 for pre-screening the ballast to separate waste therefrom falling through the ports of the bottom. In the preferred embodiment shown in the drawing, ports 13 are defined in bottom 22 in an upper portion of guide section 7. This arrangement assures a trouble-free removal of the waste without in any way interfering with the ballast cleaning operation. Also, the upward movement of the ballast frequently produces an intensive friction between the relatively moving ballast stones so that any jamming of accumulated waste rubbed off the stones is resolved before it has reached the upper portion of guide section 7 and waste may thus be removed through ports 13 even when the excavated ballast is heavily encrusted.

As shown in the drawing, the machine further comprises vibratory screening means 15, well known in this type of ballast cleaning machine and arranged to receive the pre-screened ballast from the upwardly extending elongated chain section to separate residual waste therefrom, a cleaned ballast component remaining on the screening means and the residual waste falling therethrough. Conveying means for conveying the waste away comprises waste conveyor band 12 having a waste receiving portion arranged below vibratory screening means 15 and, in the preferred embodiment illustrated herein, ports 13 in bottom 22 of guide section 7 are arranged above the waste conveyor band. This arrangement is particularly advantageous because it requires no special structure for the conveyance of the waste falling through ports 13. Advantageously, chute 14 is arranged to receive the waste from ports 13 in bottom 22 and to convey the received waste to waste conveyor band 12.

According to a preferred feature of the present invention, ports 13 are adjacently arranged elongated slits extending in the direction of the upwardly extending elongated chain section and these slits preferably have a width not exceeding about 15 mm. This enables the waste rubbed off the ballast during its upward movement to be continuously pressed through elongated slits 13 over an elongated path, causing even larger waste particles approaching the size of the smallest ballast stones acceptable for the cleaned ballast to be removed through the slits. The entire process involves a kind of self-cleaning operation since, for example, larger ballast stones, which may have fallen into the slits with a narrow elongated part thereof, are entrained by the forward movement of other stones. In this manner, the slits remain substantially open at all times for the removal of waste rubbed off the ballast stones and deposited on bottom 22.

Waste conveyor band 12 extends centrally in the direction of arrow 16 through ballast screening means 15 and slants upwardly to the front end of machine 1 where vertically movable waste discharge conveyor band 17 is arranged to receive the waste from conveyor band 12. The waste discharge conveyor band may be swung out laterally to throw the waste onto the track shoulder or into a truck. This arrangement is conventional, as is conveying means 18 for redistributing the cleaned ballast component. Conveying means 18 includes two conveyor bands mounted below screening means 15 and receiving the cleaned ballast therefrom, each conveyor band being associated with a respective one of the track rails and having a rear end thereof pivoted to the machine for a lateral pivoting movement of the conveyor band to redistribute the cleaned ballast under the track.

Figure 3:
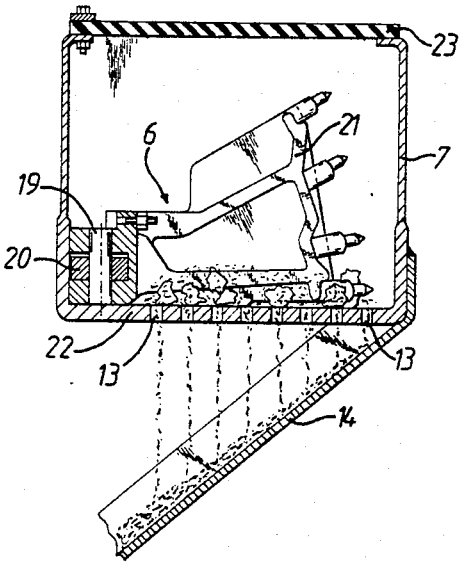
FIG. 3 is an enlarged cross sectional view of the guide and the upwardly extending elongated excavating chain section supported therein, along line III of FIG. 1.

Guide 7 for the upwardly elongated chain section conveying the excavated ballast to vibratory screening means 15 is best shown in FIG. 3. An illustrated guide 7 is channel-shaped and has bottom 22 to constitute a guide track for moving chain 6. The excavating chain comprises a series of scraper elements 21 reinforced by transversely extending ribs and having four wear-resistant scraper fingers for loosening the ballast as the chain moves in the direction of arrow 11 through the ballast under the track. Opposite the scraper fingers, scraper element 21 defines a bore receiving chain bolt 19 which is secured in position by a safety screw and adjacent scraper elements are linked together by intermediate link 20, ballast excavating chains of this general type being well known to those skilled in the art. Some ballast stones conveyed along bottom 22 by the moving excavating chain are indicated in FIG. 3.

Figure 2:
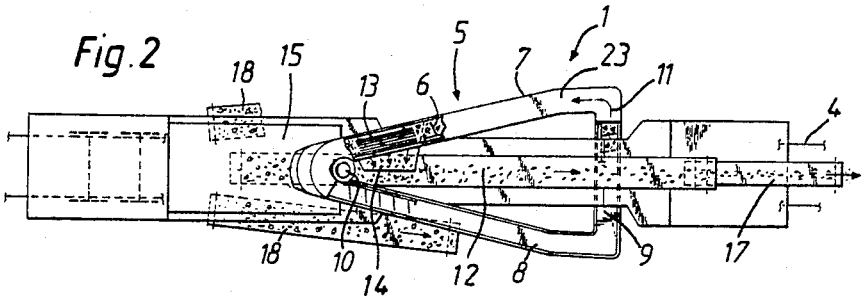
FIG. 2 is a top view of the machine.

According to the present invention, bottom 22 of channel-shaped guide 7 defines a plurality of ports 13, the illustrated ports being adjacently arranged elongated slits extending in the direction of the elongated chain section. To prevent useful ballast stones from being lost and to assure that such ballast stones reach screening means 15 for cleaning and subsequent redistribution to the track bed, the slits have a width not exceeding about 15 mm so that any ballast stones exceeding this size are retained in the guide and are conveyed by the chain to the screening means. For safety reasons, channel-shaped guide section 7 is covered by cover plate 23 of rubber. For a better view and to show ports 13, this cover plate is only partially shown in FIG. 2.

The operation of the ballast cleaning machine will partly be obvious from the above description of its structure and will be explained in detail hereinbelow:

As machine 1 is propelled along track 4 in the direction of arrow 4 while the transverse section of excavating chain 6 is immersed in ballast 3 and is moved in the direction of arrow 11 to excavate the ballast, the upwardly extending elongated chain section conveys the ballast, together with waste mixed therewith or encrusting the ballast stones, in channel-shaped guide section 7 and loose waste material is separated from the conveyed ballast as it falls through ports 13 in bottom 22 into chute 14 which conveys the separated waste to waste conveyor band 12 disposed therebelow. The ballast is thus pre-screened and this pre-screened ballast is further conveyed upwards to be discharged at the highest point of the excavating chain onto vibratory screening means 15 in a manner well known to those skilled in the art. The illustrated screening means is generally conventional and comprises three superposed screens classifying the ballast during cleaning into three sizes. The residual waste separated from the ballast on the vibratory screening means falls onto waste removal conveyor band 12 which conveys away, together with the waste coming from chute 14. The cleaned ballast falls onto pivotal conveyor bands 18 which distribute it over the sub-grade as they sweep laterally over the track bed. The waste is conveyed to rapidly moving waste discharge band 17 which throws it onto the track shoulder or into trucks standing by the side of the track.

While the invention has been described and illustrated in connection with a specific example of a ballast cleaning machine, this term is used throughout the specification and claims as applying equivalently to any mobile installation for receiving, cleaning and, optionally, redistributing ballast, such as suitable combinations of ballast excavating and screening means with such installations as track renewal trains, for example. Also, the ports in the bottom of the channel-shaped guide track for the upwardly extending elongated excavating chain section may extend along any desired portion thereof, including its entire length. Similarly, if desired, special and separate waste removal conveyor bands may be disposed below the ports to receive and convey the waste falling therethrough. Other modifications may occur to those skilled in the art without departing from the spirit and scope of this invention as defined in the appended claims.

What is claimed is:

1. A mobile ballast cleaning machine comprising (a) ballast excavating and receiving means including an endless ballast conveying chain movable in a conveying direction, the chain having arranged sequentially in the conveying direction (1) a transverse chain section for excavating the ballast, (2) an upwardly extending elongated chain section for conveying the excavated ballast, the upwardly extending elongated chain section being supported in a guide of channel-shaped cross section and having a bottom defining a plurality of ports for pre-screening the conveyed ballast to separate waste therefrom falling through the ports in the bottom, and (3) a descending elongated chain section leading to the transverse chain section, (b) a vibratory screening means arranged to receive the pre-screened ballast from the upwardly extending elongated chain section to separate residual waste therefrom, a cleaned ballast component remaining on the screening means and the residual waste falling therethrough, and (c) conveying means for conveying the waste away, the conveying means comprising a waste conveyor band having a waste receiving portion arranged below the vibratory screening means, and the ports in the bottom of the guide being arranged above the waste conveyor band.

2. The ballast cleaning machine of claim 1, further comprising conveying means for redistributing the cleaned ballast component.

3. The ballast cleaning machine of claim 1, wherein the ports are defined in the bottom in an upper portion of the upwardly extending elongated chain section.

4. The ballast cleaning machine of claim 1, further comprising a chute arranged to receive the waste from the ports in the bottom of the guide and to convey the received waste to the waste conveyor band.

5. The ballast cleaning machine of claim 1, wherein the ports are adjacently arranged elongated slits extending in the direction of the elongated chain section.

6. The ballast cleaning machine of claim 5, wherein the slits have a width not exceeding about 15 mm.

* * * * *